United States Patent [19]

Seelig et al.

[11] 4,327,527

[45] May 4, 1982

[54] APPARATUS AND METHOD FOR ADJUSTING THE TORSIONAL OUTPUT OF A FLEXIBLE PIVOT

[75] Inventors: Frederick A. Seelig, New Hartford; William E. Coman, Newport, both of N.Y.

[73] Assignee: The Bendix Corporation, Teterboro, N.J.

[21] Appl. No.: 164,668

[22] Filed: Jun. 30, 1980

[51] Int. Cl.[3] ..... B24C 1/00; B24C 3/18; B23Q 17/00

[52] U.S. Cl. ..... 51/416; 29/173; 29/407; 51/319

[58] Field of Search ..... 51/5 A, 410, 415, 416, 51/319, 320, 321, 323; 29/173, 407; 73/847, 161, 862.19; 308/2 R, 2 A; 267/160

[56] References Cited

U.S. PATENT DOCUMENTS

| | | | |
|---|---|---|---|
| 2,113,550 | 4/1938 | Nieman | 73/161 |
| 2,182,519 | 12/1939 | Handy | 73/161 |
| 2,589,401 | 3/1952 | Krahulec | 73/161 |
| 3,453,781 | 7/1969 | Greenman | 51/415 |
| 3,665,570 | 5/1972 | Brooks | 51/319 |
| 3,807,254 | 4/1974 | Brakebill | 29/407 |

*Primary Examiner*—Nicholas P. Godici

*Attorney, Agent, or Firm*—Anthony F. Cuoco; James R. Ignatowski

[57] ABSTRACT

An apparatus for adjusting the torsional output of a flexible pivot assembly is provided. The apparatus precisely rotates the flexible pivot to a maximum rotational angle at which the torsional output of the flexible pivot is trimmed to a predetermined value by an air abrasive unit. After the trimming the flexible pivot is rotated to an intermediate rotational angle and its torsional output rechecked. Electronic circuits are included to automatically control the air abrasive unit to trim output torque of the flexible pivot to its desired value, and to signify the torsional output at the intermediate rotational angle is within specifications.

34 Claims, 10 Drawing Figures

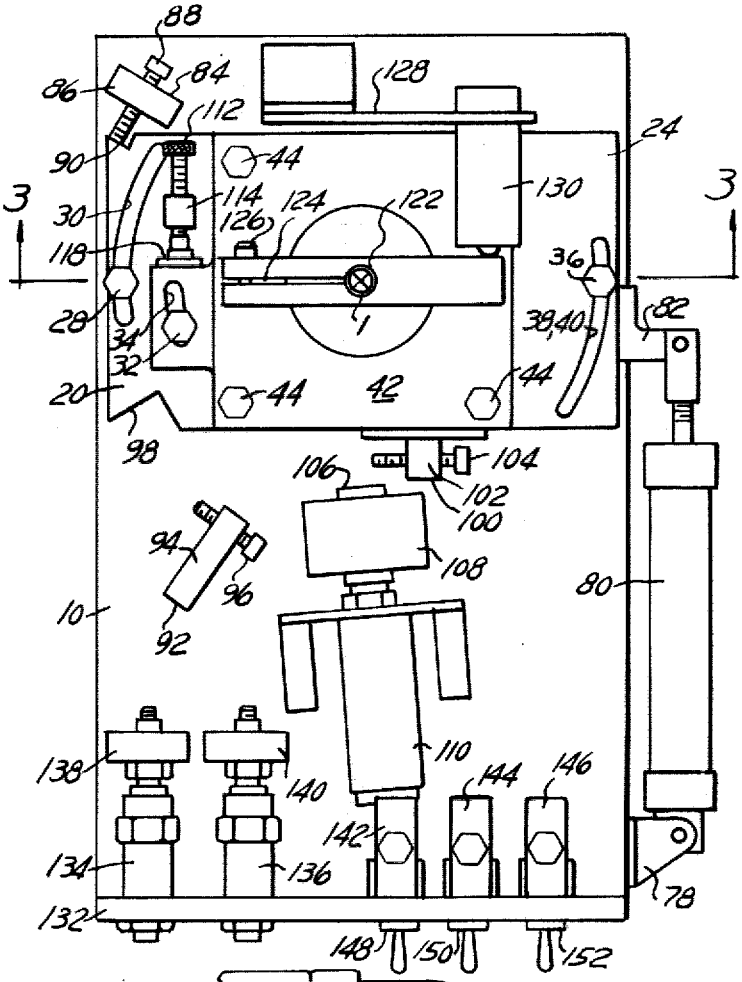
FIG. 2
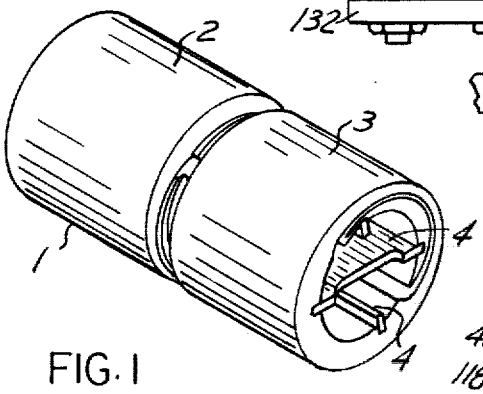
FIG. 1
FIG. 3

FIG. 4
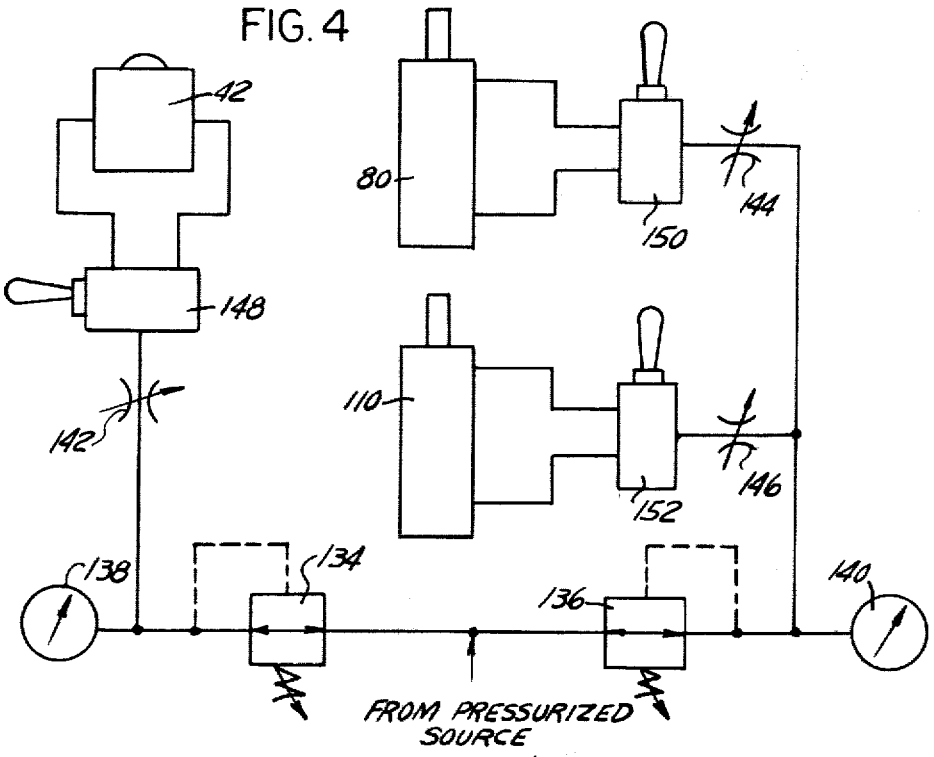
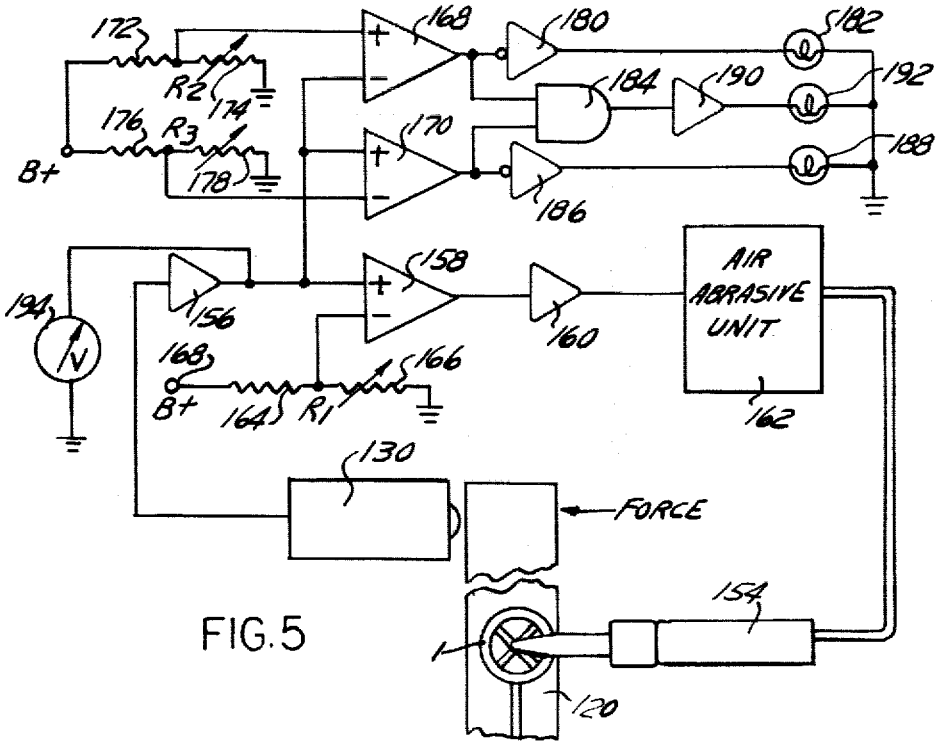
FIG. 5

FIG. 6
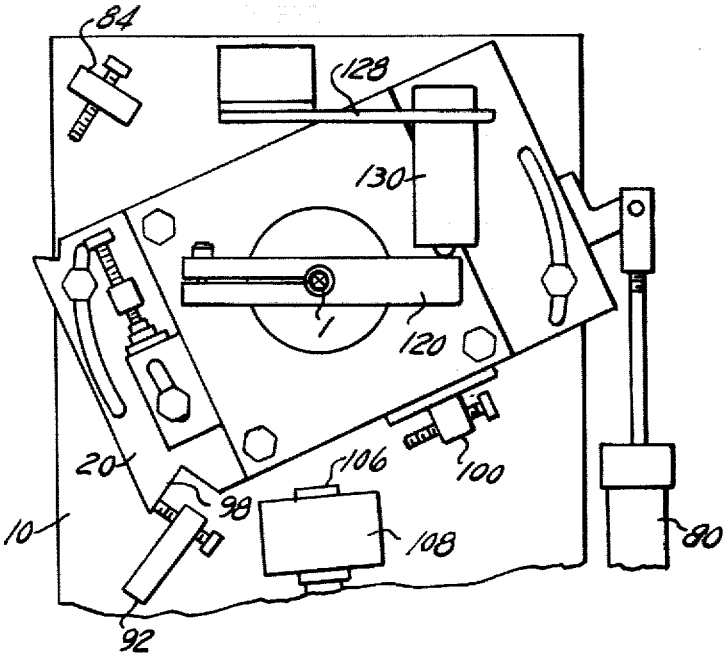
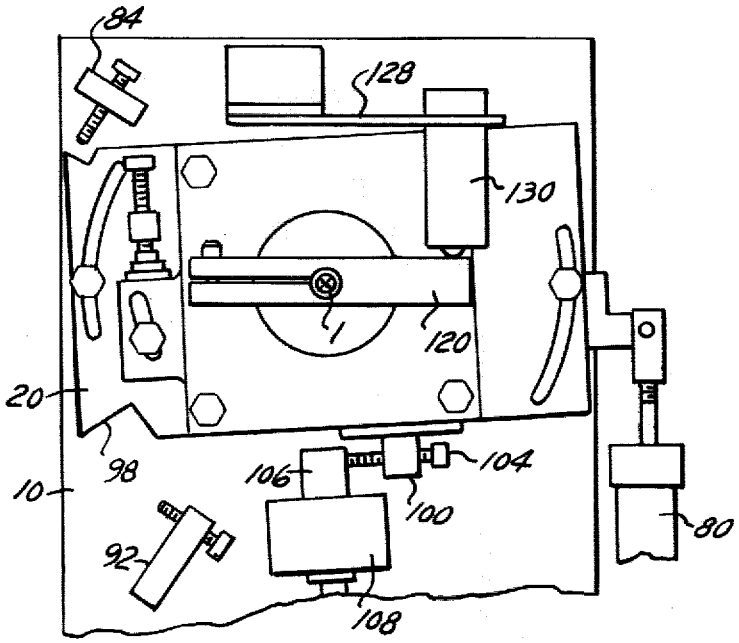
FIG. 7

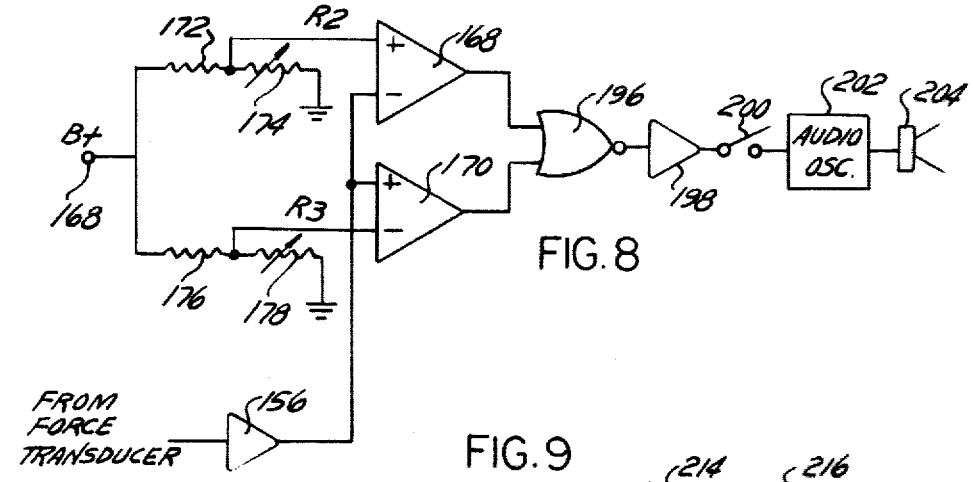
FIG. 8
FIG. 9
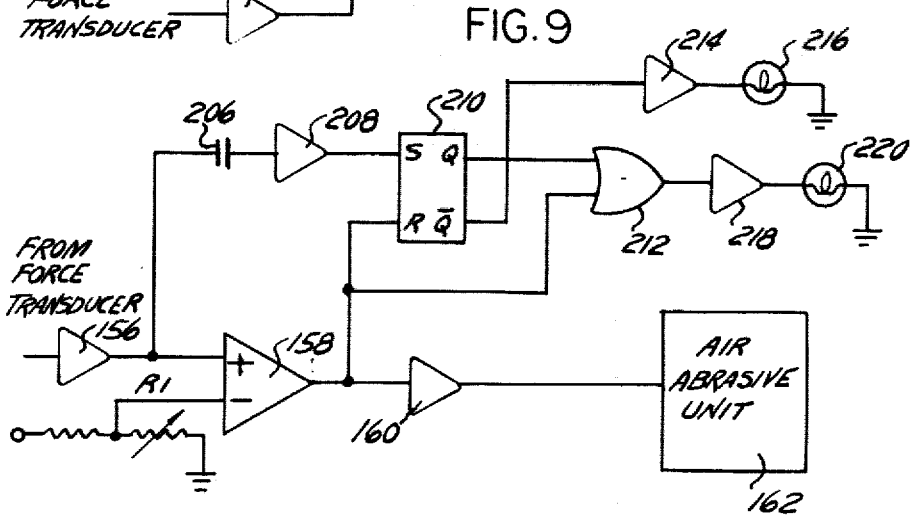
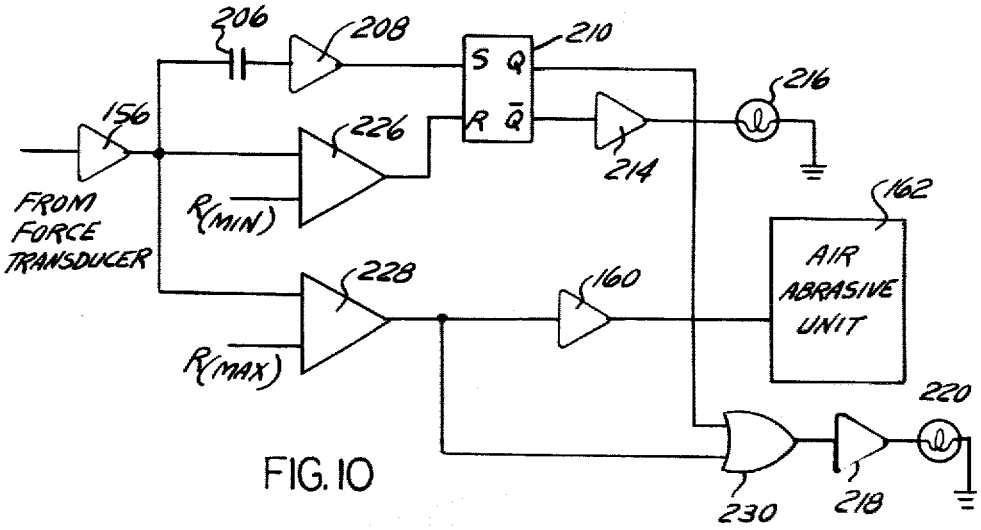
FIG. 10

APPARATUS AND METHOD FOR ADJUSTING THE TORSIONAL OUTPUT OF A FLEXIBLE PIVOT

BACKGROUND OF THE INVENTION

1. Field of the Invention

The field of the invention is related to apparatus for adjusting the torsional output of a flexible member and in particular to an apparatus for automatically adjusting the torsional output of a flexural pivot.

2. Description of the Prior Art

Flexible pivots such as the flexural pivots exemplified by U.S. Pat. Nos. 3,813,089 (Troeger) 3,811,665 (Seelig), 3,319,951 (Seelig) and 3,142,888 (Troeger) have found wide acceptance in industrial and commercial applications. The flexural pivots of the type disclosed in the above patents comprises two generally cylindrical members tandemly arranged which are capable of rotating with respect to each other about a common axis. The two cylindrical members are internally interconnected by flexure members, generally in a cruciform arrangment. The torque or rotational force generated by a flexural pivot is a function of several parameters, such as the rotational displacement angle between the two cylindrical members, the internal diameter of the cylindrical members and the physical shape and characteristics of the interconnecting flexure elements.

Many applications of these flexural pivots require that they have specified spring rates at predetermined intervals of angular rotation. This spring rate is normally defined as an output torque or force generated by the flexural pivot at one or more predetermined angular displacements between the two cylindrical members.

Quality control of the manufacturing processes of the flexural pivot is capable of controlling the pivot's spring rate within nominal limits. However for a relatively large number of applications these nominal limits are too broad. In order to meet the spring rate requirement for these special applications, the past practice has been to test each flexural pivot produced and select only those having the desired spring rate. The testing and selecting process was slow and tedious and required that a considerable number of pivots be made to obtain the number having the desired spring rate. The disclosed apparatus provides a method for simultaneously testing and adjusting the spring rate of the flexural pivots to meet the predetermined specifications.

SUMMARY OF THE INVENTION

The invention is an apparatus and method for adjusting the spring rate or torsional output of a flexible pivot assembly. The apparatus comprises a rotary stage which is capable of being precisely rotated between at least three predetermined angular positions. One of the angular positions defining the zero or rest position, the second angular position defining a maximum displacement angle, and the third angular position defining an intermediate displacement angle between the zero position and the maximum displacement angle. An air chuck, adapted to hold one end of the flexural pivot, is mounted on the rotary stage and rotates concentrically therewith. A torsion arm attached to the other end of the flexural pivot engages a force transducer which produces an output signal indicative of the torque or spring rate of the flexural pivot as the rotary stage is rotated from its zero position to other positions of known angular displacement. An electronic circuit detects the output signal of the force transducer and activates an air abrasive unit when the signal from the force transducer indicates the torque generated by the flexural pivot exceeds the specified or desired spring rate. The air abrasive unit provides a flow of abrasive particles suspended in a high velocity air flow which is directed at the internal torsional elements of the flexural pivot under test. The abrasive particles erode the flexure elements reducing the generated torque. When the torque of the flexural pivot is reduced to the specified value, the electronic circuit turns the air abrasive unit off. The rotary stage is then rotated to the intermediate angular position and the torque produced at the intermediate position is checked. The torque at the intermediate position may be checked automatically by an auxiliary circuit or by the operator viewing a meter displaying the output of the torque transducer.

The object of the invention is an apparatus and method for testing and adjusting the torsional output of a flexural pivot. Another object of the invention is an apparatus which will automatically trim the torsional output of a flexural pivot to a predetermined value at a given rotational displacement. Still another object of the invention is an apparatus which will check the torsional output of the flexural pivot at at least one intermediate angular displacement.

These and other objects of the invention will become apparent from reading the detailed description of the invention in conjunction with the drawings.

BRIEF DESCRIPTION OF THE DRAWINGS

FIG. 1 is a perspective view of a typical flexural pivot.

FIG. 2 is a plan view of the apparatus for rotating the flexural pivot.

FIG. 3 is a cross-sectional side view of the apparatus shown in FIG. 2.

FIG. 4 is a diagram of the pneumatic actuating circuit.

FIG. 5 is a diagram of the electronic control circuit.

FIG. 6 is a plan view of the apparatus of FIG. 2 with the rotary stage rotated to its maximum angular position.

FIG. 7 is a plan view of the apparatus of FIG. 2 with the rotary stage rotated to its intermediate angular position.

FIG. 8 is a diagram of an alternate circuit for making the intermediate angle check.

FIG. 9 is a diagram of a first auxiliary test circuit.

FIG. 10 is a diagram of a second auxiliary test circuit.

DETAILED DESCRIPTION OF THE INVENTION

The disclosed invention is an apparatus and method for adjusting the spring rate or torque of a flexural pivot. Referring first to FIG. 1 there is shown a a typical Flexural Pivot 1 such as disclosed in U.S. Pat. No. 3,813,089. The Flexural Pivot comprises a first cylindrical member 2, a second cylindrical member 3, and flexural members 4 internally interconnecting the first and second cylindrical members in a known way. The first cylindrical member 2 and second cylindrical member 3 may be rotated relative to each other about a common axis concentric with the two cylinders. When the two cylinders are rotated with respect to each other, the flexural members 4 produce a force or torque tending to return the two cylindrical members to their origional positions.

The details of the disclosed apparatus for adjusting the spring rate of flexural pivot are illustrated on FIGS. 2 and 3. The apparatus comprises a generally retangular base 10 having an aperture 12 formed therethrough approximately equidistant from three contiguous edges. The top surface of the base 10 has an annular shoulder 14 concentric with said aperture 12 which forms a seat for an annular bushing 16. The bushing 16 is fixedly attached to the base 10 by a series of equally spaced fastners, such as screws 18. A rotary stage 20 having a circular aperture 22 is rotatably disposed on top of the base 10 with its circular aperture 22 circumscribing the annular bushing 16. A zero adjustment stage 24 having a circular aperture 26 is rotatably disposed over the rotary stage 20 with its aperture 26 likewise circumscribing the annular bushing 16. One end the rotary stage 20 is rotatably secured to the base 10 by means of bolt 28 passing through an arcuate slot 30. In a similar manner, one end of the zero adjustment stage 24 is rotatably secured to the rotary stage 20 by means of a bolt 32 passing through an arcuate slot 34. The other ends of the zero adjustment stage 24 and rotary stage 20 are rotatably secured to the base by means of bolt 36 passing through arcuate slots 38 and 40 formed through the zero adjustment stage 24 and rotary stage 20 respectively. Arcuate slot 34 limits the rotation of the zero adjustment stage 24 with respect to the rotary stage 20. Arcuate slots 30, 38 and 40 limit the rotation of the rotary stage 20 with respect to the base 10.

An air clamp 42 such as MEAD Model PCF Collet Fixture manufactured by MEAD DIV. of Stanray Corp. of Chicago, Ill. is attached to the zero adjustment stage 24 by means of 4 corner bolts 44. The air clamp 42 is of convential design and comprises a housing 46, a chuck 48 and a base plate 50. The housing 46 has a conical aperture 52, a cylindrical pressure chamber 54, and a cylindrical extension 56 interconnecting the conical aperture 52 with the pressure chamber 54. The housing also includes an upper or clamp port 58 and a lower or release port 60 connecting the upper and lower portions of the pressure chamber respectively to the exterior of the housing 46. Clamp port 58 and release port 60 receive pressurized air from an external source as shall be explained later.

The chuck 48 has an upper conical section 62, a cylindrical section 64, an extension 66, and a cylindrical bore 68. The chuck 48 is received in the housing 46 as shown. The conical section 62 is longitudinally segmented (not shown) so that it is free to expand or contract within the conical bore 52 of the housing as the chuck 48 in moved axially with respect to housing 46. The upper end of the conical section 62 has an aperture for receiving a Flexural Pivot 1.

A piston 72 is captivated between a shoulder formed at the base of the cylindrical section 64 and a threaded nut 74. The piston 72 is disposed approximately midway between clamp and release ports 58 and 60 respectively, dividing the pressure chamber 54 into an upper and lower section. A hose 76 is connected to the end of the chuck's extension 66. Appropriate seals are provided as shown to prevent fluid leakage as either the upper or lower portions of the pressure chamber 54 are pressurized to move the chuck 48 axially within the housing.

Returning now to FIG. 2, a first air cylinder 80 is connected between a first bracket 78 attached to the base plate 10 and a second bracket 82 attached to rotary stage 20. Extension of the air cylinder 80 causes the rotary stage 20 to rotate about annular bushing 16 in a counter clockwise direction. A first mechanical stop 84 comprising bracket 86 and adjustable screw 88 is engaged by a dog 90 formed in the rotary stage 20. This first stop 84 sets the 0° reference angle of the rotary stage 20 with respect to the base 10.

A second mechanical stop 92 comprising bracket 94 attached to the base plate 10 and adjustable screw 96 is placed to engage a second dog 98 formed in the rotary stage 20. The second stop 92 defines the maximum counter clockwise rotational angle of the rotary stage 20 with respect to the base 10.

A third mechanical stop 100 comprising bracket 102 attached to the rotatable stage 20 and adjustable screw 104 defines an intermediate angular position. The stop 100 engages a stop member 106 slidably received in a support block 108 attached to the base 10. The position of stop member 106 is controlled by a second air cylinder 110 attached to base 10. The air cylinder 110 is operative to extend the stop member 106 to engage the mechanical stop 100 as the rotary stage 20 is rotated by air cylinder 80 from its maximum displaced position against stop 92 towards its 0° position. When the rotary stage 20 is rotated counter clockwise from its 0° position towards stop 92, the stop member 106 is withdrawn by the air cylinder 110 as shown in FIG. 1 permitting stop 100 to pass.

Incremental angular adjustment between the zero adjustment stage 24 and the rotatable stage 20 is provided by means of an adjustment screw 112 threadably received in a support block 114 attached to the rotary stage 20. The end of adjustment screw 112 is rotatably attached to plate 118 extending upwardly from zero adjustment stage 24.

A torsion arm 120 is attached to the upper portion of the Flexural Pivot 1 to be adjusted. The torsion arm 120 has a circular aperture 122 circumscribing the Flexural Pivot 1, a linear slot 124 extending from the circular aperture 122 to one end of the torsion arm, and a clamping screw 126.

A force transducer 130 such a *Schaevitz Transducer* Model No. FTAG-100 manufactured by Schaevitz Engineering Co. of Pennsauken, N.J. engages the end of the torsion arm 120 opposite the tightening screw 126. The force transducer 130 is fixedly attached to the base 10 by means of a support bracket 128.

Referring now to FIGS. 2, 3 and 4, an upright or vertical panel 132 supports a pair of pressure regulators 134 and 136 receiving air from a souce of air pressure (not shown). The output of pressure regulator 134 is connected to a pressure gauge 138 and to a first needle valve 142. The output of pressure regulator 136 is connected directly to a pressure gauge 140 and to the inputs of a second and a third needle valve, 144 and 146 respectively. The outputs of needle valves 142, 144 and 146 are respectively connected to manually actuated 4 way pneumatic valves 148, 150 and 152.

The outputs of pneumatic valve 148 are connected to the clamp and release ports 58 and 60 of the pneumatic chuck 42. The outputs of pneumatic valve 150 are connected to air cylinder 80 while the outputs of pneumatic valve 152 are connected to air cylinder 110. The interconnections between the pressure regulators 134 and 136 needle valves 142, 144 and 146 pneumatic valves 148 150 and 152 pneumatic chuck 42 and air cylinders 80 and 110 are illustrated in the pneumatic circuit shown in FIG. 4, but are omitted in FIGS. 2 and 3 to simplify the drawings. Those skilled in the art will recognize that the disclosed pneumatic circuit could be replaced with a corresponding electric or hydraulic circuit with manual or automatic controls without departing from the spirit of the invention.

The spring rate or torsional output of the Flexural Pivot 1 is adjusted by abrasive trimming of its flexural members at a predetermined angle of deflection with an air abrasive unit. The abrasive trimming is accomplished by directing a pressurized air flow containing abrasive particles generated by the air abrasive unit against the flexure members.

Referring back to FIG. 3, there is shown the output nozzle 154 of an Airabrasive Unit 162 as shown in FIG. 5 such as an SS White Division of Penwalt Corp. Model No. MAT manufactured by SS White Co. of Pescalaway, N.J. The trimming of the flexural pivots flexural members may be accomplished manually by an operator watching the output of the force sensor 130 displayed on a meter such as meter 194 shown on FIG. 5 and stopping the abrasion when the displayed output reaches a predetermined value.

Alternatively the trimming may be automatically performed using the circuit shown in FIG. 5. Referring now to FIG. 5, the output of the force transducer 130 is connected to a non-inverting amplifier 156. The output of amplifier 156 is connected to the positive input of a comparator 158. The negative input of the comparator 158 receives a reference signal R1 at its negative input from a voltage divider network comprising fixed resistor 164 and variable resistor 166 connected between a source of DC electrical power, designated B+, received at terminal 168 and ground. The output of the comparator 158 is connected to a noninverting amplifier 160 which has its output connected to the Airabrasive Unit 162. The reference signal applied to the negative input of comparator 158 is adjusted by means of variable resistance 166 to be equal to the output of amplifier 156 when a predetermined force is applied to force transducers 130 by torsion arm 120.

The circuit includes an intermediate angle checking circuit including comparator 168 and 170. The negative input of comparator 168 is connected to the positive input of comparator 170 and the output of noninverting amplifier 156. A second reference signal R2 indicative of the maximum allowable value of the output of amplifier 156 for a predetermined intermediate angular deflection of the flexural pivot is applied to the positive input of comparator 168. The second reference signal $R_2$ may be generated by a voltage divider comprising fixed resistance 172 and variable resistance 174 connected between B+ and ground. A third reference signal $R_3$ indicative of the minimum allowable value of the output of amplifier 156 for the predetermined intermediate angular deflection of the flexural pivot is applied to the negative input to comparator 170. The third reference signal $R_3$ may be generated by a voltage divider comprising fixed resistance 176 and variable resistance 178 connected between B+ and ground.

The output of comparator 168 is connected to the input of an inverter amplifier 180 and an input to AND Gate 184. The output of inverting amplifier 180 is connected to a luminous indicator 182 such as a light bulb or light emitting diode. The output of comparator 170 is connected to the input of an inverting amplifier 186 and to the other input to AND Gate 184. The output of inverting amplifier 186 is likewise connected to a luminous indicator 188. The output of AND Gate 182 is connected to a noninverting amplifier 190 which has its output connected to a luminous indicator 192.

The operation of the apparatus will be discussed with reference to FIGS. 2 through 5 and FIGS. 6 and 7 which show the rotable stage displaced at its maximum predetermined angle and at the intermediate angle respectively. The torsional arm 120 is attached to the upper portion of Flexural Pivot 1, the lower portion of the flexural pivot is then inserted into the air clamp 42. Switch 148 is actuated to pressurize the section of the pressure chamber 54 above piston 72 pulling chuck 48 downward and firmly clamping the lower portion of the Flexural Pivot 1.

The zero adjustment stage 24 and air clamp 42 are then rotated as a unit by adjustment screw 112 until torque arm just touches the contact point of the force transducer 130. An indicator, such as meter 194 may be used during this adjustment to avoid placing an initial or zero offset torque on the flexural pivot. Meter 194 will also give a visual display indicative of the pivot's spring rate at the second and third positions of the rotary stage. Meter 194 is preferably a digital display. Switch 150 is then actuated pressurizing air cylinder 80 to rotate the rotary stage 20 until dog 98 engages mechanical stop 92 as shown in FIG. 6. The lower portion of the Flexural Pivot 1 rotates with the air clamp 42 and rotary stage 20 causing the upper portion via torque arm 120 to apply a force to force transducer 130 producing a (force) output signal. When the output signal of the force transducer 130 amplified by amplifier 156 exceeds the reference signal $R_1$, comparator 158 produces an output trim signal activating the Airabrasive Unit 162 through amplifier 160. When activated, the Airabrasive Unit 162 generates an air flow containing abrasive particles which is directed by nozzle 154 to pass through the Flexural Pivot 1 eroding its flexure members. The air flow and abrasive particles flow through the flexural pivot, the cylindrical bore 68 of the chuck 48 and back to the Airabrasive unit via tubing 76. When the flexure members of the flexural pivot have eroded sufficiently to cause output of amplifier 156 to equal the reference signal $R_1$, the output signal of comparator 158 is terminated, turning off the Airabrasive unit 162. The spring rate of the Flexural Pivot has now been adjusted to produce a predetermined torque at a first specified (predetermined) angular rotation.

The torque produced at an intermediate displacement angle is checked by actuating first switch 152 which causes air cylinder 110 to extend stop member 106 into the path of stop 100. Switch 150 is then actuated to retract air cylinder 80 rotating the rotable stage 20 in a clockwise direction until stop 100 engages extended stop member 106 as shown in FIG. 7. If at intermediate angle the output signal from amplifier 156 is between the predetermined maximum and minimum values determined by reference signals $R_2$ and $R_3$ respectively, comparators 168 and 170 both produce high output signals which are inverted to a low output signal by inverter amplifiers 180 and 186. Luminous indicates 182 and 188 are not activated by these low signals and remain "off". The two high signals from comparators 180 and 186 however activate AND gate 184 to produce an output which is amplified by noninverting amplifier 190. The output of amplifier 190 will excite or turn "on" luminous indicator 192. Normally luminous indicator 192 will be green in color indicating that the torque generated at the intermediate angular position is within the predetermined limits.

Alternatively if the output from amplifier 156 is not within is not within the limits defined by reference signals $R_2$ and $R_3$, either comparator 168 or 170 will generate a low signal. A low output signal from either comparator will deactive AND gate 184 extinguishing luminous indicator 192 and activates its associated inverter amplifier 180 or 186 to produce a high output signal which turns "ON" its associated luminous indicator. Luminous indicators 182 and 188 are normally red in color indicating that the torque at the intermediate angle is outside its predetermined limits. When luminous indicator 182 is turned "ON" the torque at the intermediate angle is too high and when display 188 is turned "ON". Alternatively luminous indicator 188 is turned "ON" when the torque is too low.

An alternate version of the intermediate check circuit is shown on FIG. 8. Basically the circuits up to the output of the comparators 168 and 170 are the same as that shown on FIG. 5 and have the same identifying indicia. In the embodiment of FIG. 8 the outputs of the two comparators 168 and 170 are connected to the inputs of NOR gate 196 which has a low output when the outputs of both comparators are high. The output of NOR gate 196 goes high when the output of one of the comparators goes low signifying the torque at the intermediate angle is outside its predetermined limits. The output of NOR gate 196 is amplified by noninverting amplifier 198 and applied to the input of an audio oscillator 202 through a mechanical switch 200. Switch 200 is closed only when the rotary stage 20 is in the intermediate angular position otherwise it is open. The output of the audio oscillator 202 is connected to an audio speaker 204.

The operation of the alternate circuit is as follows. When the rotary stage 20 is in the intermediate angular position, switch 200 is closed connecting the output of amplifier 198 to the audio oscillator 202. If the output of amplifier 156 is between the reference signals $R_2$ and $R_3$, the outputs of both comparators are high producing a low signal at its output. A low output from amplifier 198 deactivates audio oscillator 202 and no sound is produced by the speaker 204. If the output of either comparator goes low, the output of NOR gate 196 goes high which activates the audio oscillator 202 through amplifier 198. The output of audio oscillator 202 cause the speaker 204 to produce an audible sound signifying the torque at the intermediate angular position is outside its predetermined limits. Switch 200 allows the audio oscillator 202 to be activated only when the rotable stage 20 is in the intermediate angular position. This feature deactivates the sound producing system at all other positions independent of the output of amplifier 156.

Obviously a switch similar to switch 200 could be incorporated into the circuit of FIG. 5. This switch could either close the ground circuit of the luminous displays 182,188 and 192 when the check is being made at the intermediate angular position, or could switch the inputs to comparators 168 and 170 from a reference signal having a value intermediate reference signals $R_2$ and $R_3$ to the output of amplifier 156, such that the luminous indicators 182 or 188 could only be activated when the check is made at intermediate angular position. In the latter alternative the green luminous indicator 192 will remain on at all other angular positions so as to not falsely alarm the operator.

Another auxiliary circuit that may be added which indicates the completion of the trimming process at the maximum angle is shown in FIG. 9. In this circuit the output of amplifier 156 is connected to the set (S) input of an R-S Flip-Flop 210 through a capacitance 206 and amplifier 208. The reset (R) input of Flip-Flop is 210 is connected directly to the output of comparator 158. The Q output of Flip-Flop 210 is connected to one input of an OR gate 212 while is Q output is connected to an amplifier 214. The output of amplifier 214 is connected to the input of a luminous indicator 216 illustrated as light bulb which may be green in color.

The other input to OR gate 212 is also connected directly to the output of comparator 158. The output of the OR gate 212 is connected to amplifier 218 having its output connected to a luminous indicator 220 normally red in color.

The operation of the auxiliary circuit shown on FIG. 9 is as follows. As the rotary stage 20 is rotated by piston 80 from its first angular position, to the second angular position the force transducer 130 produces an increasing output signal which is amplified by amplifier 156. The increasing output signal generated by amplifier 156 is passed by capacitor 206 and amplifier 208 generates a signal placing Flip-Flop 210 in its set state. The Q output of Flip-Flop 210 goes low extinguishing the output of luminous indicator 216 and the Q output goes high turning on luminous indicator 220 through OR gate 212 and amplifier 218.

When the output of comparator 158 goes high in response to the torque generated by the flexible pivot exceeding the reference signal $R_1$, Flip-Flop 210 is reset and its Q output goes high turning luminous indicator 216 back "ON". The turning "ON" of luminous indicator 216 indicates the spring rate of Flexural Pivot 1 has exceeded the reference signal $R_1$ and is being trimmed by the Airabrasive Unit 162 back to that value. If luminous indicator 216 does not turn "ON" it indicates the torque produced by the flexural pivot is below its specified value.

Considering that the torque produced by the Flexural Pivot 1 exceeded the reference signal $R_1$, and luminous indicator 216 is turned in response to the output of comparator 158 going high. The output of comparator 158 applied to OR gate 212 keeps luminous indicator 220 (a red light) turned "ON" until the trimming is completed. Upon completion of the trimming process the output of comparator 158 goes low and the red indicator 220 is turned "OFF". Simultaneous excitement of the luminous indicators, 216 and 220 signifies the trimming of the Flexural Pivot 1 is in progress. When red luminous indicator 220 is turned "OFF" at the end of the trimming process only the green indicator 216 remains "ON" signifying the flexural pivot has been trimmed to the desired spring rate and the check at the intermediate rotational position should be made.

Alternatively if the torque generated by the flexural pivot is less than the desired torque, the output of comparator 158 will not go high resetting Flip-Flop 210 and green indicator 216 will not be turned "ON", however red indicator 220 will be turned "ON" when Flip-Flop 210 is placed in its set state. The lighting of red indicator 220 alone signifies the torque produced by the Flexural Pivot 1 was less than the desired value. Luminous indicator 220 will not be extinguished since the output of comparator 158 will not go high resetting Flip-Flop 210 as would occur when the output of amplifier 156 exceeds the value of reference signal $R_1$.

As is known in the art, comparator 158 may be replaced with two comparators as shown in FIG. 10. A first comparator 226 receives a reference signal $R_{(MIN)}$ indicative of the minimum desired spring rate for the flexural pivot and a second comparator 228 receives a reference signal $R_{(MAX)}$ indicative of the maximum desired spring rate of the flexural pivot. The output of the first comparator 226 resets Flip-Flop 210 and the output of the second comparator 228 controls the Airabrasive Unit 162 and the excitation of luminous indicator 220.

When the signal from amplifier 156 is increasing Flip-Flop 210 is placed in its set state. If the signal from amplifier 156 does not exceed the minimum reference signal $R_{(MIN)}$ Flip-Flop 210 remains in the set state and a red indicator 220 is turned on by the Q output of Flip-Flop 210 through OR gate 230. If the output of amplifier 156 exceeds the reference signal $R_{(MIN)}$ but not the reference signal $R_{(MAX)}$, Flip-Flop 210 is reset by the output of comparator 226 turning "ON" green indicator 216 and turning "OFF" red indicator 220. When the output of amplifier 156 exceeds reference signal $R_{(MAX)}$, the output of comparator 226 resets Flip-Flop 210 and output of comparator 228 turns on red indicator 220 through OR gate 230. Both the green indicator 216 and red indicator 210 are turned "ON" as previously described. After the spring rate of the flexural pivot is trimmed so that the output of amplifier 156 is below the reference signal $R_{(MAX)}$, the output of comparator 228 goes low extinguishing red indicator 220 indicating the trimming is complete.

It is recognized that other circuits may be used to indicate when the values of the flexural pivot's spring rate has the desired values or other mechanism may be used to produce the desired angular positioning without departing from the spirit of the invention.

What is claimed is:

1. An apparatus for adjusting the spring rate of a resilient article operative to produce a torsional force about a predetermined axis of rotational displacement, characterized by:

a rotary stage having an axis of rotation;

means attached to said rotary stage for fixedly holding one end of said resilient article with said predetermined axis of rotational displacement concentric with axis of rotation;

means for precisely rotating said rotary stage about said axis of rotation between a first angular position and at least a second angular position;

stationary force transducer means connected to the other end of said resilient article for generating a force signal indicative of the torsional force generated by the resilient article when said rotary stage is rotated from said first to said second angular position; and air abrasive means for abrading the resilient member to reduce said force signal to a desired value with said rotary stage in said second position.

2. The apparatus of claim 1 wherein said rotary stage comprises:

a base; and a first stage member rotatably attached to said base concentric with said axis of rotation.

3. The apparatus of claim 2 wherein said rotary stage further includes a second stage member rotatably attached to said first stage concentric with said axis of rotation, and means for incrementally rotating said second stage member with respect to said first stage member.

4. The apparatus of claim 3 wherein said means for rotating includes:

a first and a second mechanical stop attached to said base and engaged by said first stage to define said first and second angular positions of said first stage member with respect to said base;

an air cylinder attached between said base and said first stage member for rotating said first stage member with respect to said base;

an air cylinder control for actuating said air cylinder to move said first stage member between said first and second mechanical stops.

5. The apparatus of claim 4 wherein said means for rotating includes a third mechanical stop defining a third angular position of said first stage member intermediate said first and second angular positions, said third mechanical stop include:

a third stop member having an extended position engaging said first stage and a retracted position; and means for extending and retracting said third mechanical stop between said extended and retracted positions.

6. The apparatus of claim 1 wherein said means for holding one end of said resilient article is an air clamp.

7. The apparatus of claim 1 wherein said force transducer means includes a meter producing a visual indication of the spring rate in response to said force signal.

8. The apparatus of claim 1 wherein said force transducer means includes:

means for generating a trim signal in response to said force signal having a value exceeding said desired value with said rotary stage in said second position; and a luminous indicator excited to produce a visual signal in response to said trim signal.

9. The apparatus of claim 8 wherein said air abrasive means is activated to abrade the resilient article in response to said trim signal.

10. The apparatus of claim 9 wherein said resilient article is a flexible pivot having at least one flexural element, said airabrasive means abrades said at least one flexural element.

11. The apparatus of claim 9 wherein said resilient article has a minimum and a maximum acceptable spring rate with said rotary stage in said second position, said means for generating a trim signal further includes first means for generating a first visual signal when the value of said force signal exceeds a first predetermined value indicative of the value of said minimum acceptable spring rate and second means for generating said trim signal when said force signal has a value exceeding a second predetermined value indicative of said maximum acceptable value.

12. The apparatus of claims 5 or 11 wherein said resilient article has a minimum and maximum spring rate at said third position said apparatus further includes means for generating in response to said force signal a third visual signal indicating the spring rate of said resilient article is between said maximum and minimum spring rates and for generating a fourth visual signal when the spring rate of said resilient article is not between said maximum and minimum spring rates at said third angular position.

13. An apparatus for measuring and adjusting the torsional spring rate of a resilient article comprising:

a base;

a rotary stage rotatably attached to said base;

first and second stop means mounted to said base limiting the rotation of said rotary stage between a first and a second angular position;

third stop means, movable from a first position to a second position, said third stop means in said second position limiting the rotation of said rotary stage between said second angular position and a third angular position intermediate said first and second angular positions;

means for moving said third stop means between said first and second positions in response to inputs from an operator;

holder means attached to said rotary stage for fixedly holding one end of said resilient article;

means for rotating said rotary stage into engagement with said first, second and third stop means in response to inputs from an operator;

a torque arm fixedly attached to the other end of said resilient article;

force transducer means engaged by said torque arm for producing a force signal indicative of the spring rate of said resilient article with said rotary stage in said first, second and third angular position;

first circuit means responsive to said force signal for generating a trim signal when said force signal exceeds a value indicative of a desired spring rate;

airabrasive means responsive to said trim signal for abrading said resilient article to reduce its spring rate to said desired spring rate; and means responsive to said force signal for determining the spring rate of said resilient article when said rotary stage is in said third angular position.

14. The apparatus of claim 13 further including intermediate stage means for incrementally rotating the holder means with respect to said rotary stage to adjust the value of said force signal to a predetermined value when said rotary stage is in said first angular position.

15. The apparatus of claim 14 wherein said predetermined value of said force signal is zero.

16. The apparatus of claim 13 or 15 wherein said means for rotating is an air cylinder.

17. The apparatus of claim 13 or 15 wherein said means for moving said third stop means is an air cylinder.

18. The apparatus of claim 15 wherein said first circuit means comprises:

reference signal generator means for generating at least one reference signal indicative of the desired spring rate of said resilient article with said rotary stage in said second angular position; and means for comparing said force signal with said at least one reference signal to generate said trim signal when the value of said force signal exceeds the value of said at least one reference signal.

19. The apparatus of claim 18 further including circuit means for generating visual outputs in response to said force signal and said trim signal, said included circuit means generating a first visual output in response to said force signal increasing in value as said rotary stage is rotated from said first angular position to said second angular position and for generating a second visual output in response to occurrence of said trim signal.

20. The apparatus of claim 19 wherein said reference signal generator means generates a minimum value reference signal indicative of a minimum acceptable spring rate of the resilient article with said rotary stage in said second angular position and a maximum value reference signal indicative of the maximum acceptable spring rate of the resilient article with said rotary stage in said second angular position; and wherein said means for comparing comprises:

a first comparator circuit for generating an exceeds minimum value signal in response to said force signal exceeding said minimum value reference signal; and a second comparator circuit for generating said trim signal in response to said force signal exceeding said maximum value reference signal.

21. The apparatus of claim 20 wherein said included circuit comprises:

a bi-stable circuit switchable from a first state to a second state in response to said force signal increasing in value as said rotary stage is rotated from said first to said second angular position and switchable back to said first state in response to said trim signal, said bi-stable circuit generating a pair of complementary output signals indicative of the state of said bi-stable circuit;

a gate circuit for generating an output signal in response to said trim signal and in response to one of said complementary signals indicative of bi-stable circuit being in said first state;

a first luminous display responsive to the output signal of said gate circuit for generating said first visual output; and a second luminous display responsive to one of said complementary signals indicative of said bi-stable circuit being in said second state for generating said second visual output.

22. The apparatus of claim 15 further including:

a meter giving a visual indication of the spring rate of said resilient article when said rotary stage is in said third angular position, in response to said force signal.

23. The apparatus of claim 15 further including:

a second circuit means for producing a sensual output indicative of said resilient article having the desired spring rate in response to said force signal with said rotary stage in said third angular position.

24. The apparatus of claim 23 wherein said second circuit means comprises:

second reference signal generator means for generating a first and a second reference signal indicative of the maximum and minimum acceptable values of said resilient article's spring rate respectively with said rotary stage in said third angular position;

a third comparator for generating an output signal in response to said force signal being greater than said first reference signal;

a fourth comparator for generating an output signal in response to said force signal being less than said second reference signal;

a third luminous display for generating a visual output in response to output signals generated by said third and fourth comparators.

25. The apparatus of claim 24 further including:

a fourth luminous display generating a visual output in response to the absence of the output signal generated by said third comparator and a fifth luminous display generating a visual output in response to the absence of the output signal generated by said fourth comparator.

26. The apparatus of claim 23 wherein said second circuit means comprises:

third reference signal generator means for generating a third and fourth reference signal indicative of the maximum and minimum acceptable values of said resilient article's spring rate respectively when said rotary stage is in said third position;

a fifth comparator for generating an output signal in response to said force signal being greater than said third reference signal;

a sixth comparator for generating an output signal in response to said force signal being less than said fourth reference signal;

gate means for generating an output signal in response to the absence of an output signal from either said fifth or sixth comparator;

audio means for generating an audible signal in response to the output signal generated by said gate means; and switch means for transmitting the output signal from said gate means to said audio means only when said rotary stage is in said third position.

27. The apparatus of claims 13 or 17 wherein said resilient article is a flexural pivot.

28. The apparatus of claims 18 or 23 wherein said resilient article is a flexural pivot.

29. A method for adjusting the spring rate of a resilient article operative to produce a torsional force about a predetermined axis of rotational displacement comprising the steps of:

attaching a torque arm to one end of resilient article;

mounting the other end of the resilient article to a rotary stage with said torque arm engaging a force transducer with a predetermined force when said rotary stage in a first angular position;

rotating said rotary stage to a second predetermined angular position causing said torque arm to apply a force on said force transducer indicative of the spring rate of said resilient article;

converting said applied force to a force signal with said force transducer;

comparing said force signal with a first reference signal indicative of the desired spring rate of said resilient article at said second angular position to generate a trim signal when said force signal exceeds said first reference signal;

activating an air abrasive unit with said trim signal to abrade the spring rate of said resilient article back to said desired spring rate at said second angular position; and rotating said rotary stage to a third angular position, intermediate said first and second angular positions to determine from said force signal the spring rate of said resilient article at said third angular position.

30. The method of claim 29 wherein said step of mounting includes the step of adjusting the angular position of said resilient member so that said torque arm engages said force transducer with zero force.

31. The method of claim 29 wherein the resilient article has a minimum and maximum acceptable spring rate with said rotary stage in said second position said step of comparing comprises the steps of:

comparing said force signal with a second reference signal indicative of said minimum spring rate to generate a visual output indicative that the spring rate of the resilient article exceeds said minimum acceptable spring rate; and comparing said force signal with a third reference signal indicative of said maximum spring rate to generate said trim signal when the spring rate of the resilient article exceeds said maximum acceptable spring rate.

32. The method of claim 31 further including the steps of detecting said trim signal to produce a visual output signifying the air abrasive unit is activated and the spring rate of the resilient article exceeds the maximum spring rate.

33. The method of claim 31 wherein said resilient article has a minimum and maximum acceptable value at said third angular position, said step of rotating to said third angular further includes the steps of:

comparing the force signal with a fourth and fifth reference signal respectively indicative of the acceptable minimum and maximum spring rates of said resilient article with said rotary stage in said third position to generate a check signal signifying that said force signal is between said fourth and fifth reference signal;

activating a first visual display in response said check signal to signify that the spring rate at said third angular position is acceptable; and activating a second visual display in response to the absence of said check signal to signify that the spring rate at said third angular position is not acceptable.

34. The method of claims 29 or 33 wherein said resilient article is a flexural pivot.

* * * * *